US006113113A

United States Patent [19]

Longoni et al.

[11] Patent Number: 6,113,113

[45] **Date of Patent: *Sep. 5, 2000**

[54] SLIDING APPARATUS HAVING ADJUSTABLE FLEXION AND TORSION CHARACTERISTICS

[75] Inventors: Lucio Longoni, Como, Italy; Robert J. Harrington, 75 Agnes Dr., Framingham, Mass. 01701

[73] Assignee: Robert J. Harrington, Framingham, Mass.

[ * ] Notice: This patent is subject to a terminal disclaimer.

[21] Appl. No.: 09/052,932

[22] Filed: Apr. 1, 1998

Related U.S. Application Data

[63] Continuation of application No. 08/841,920, Apr. 8, 1994, Pat. No. 5,984,343.

[51] Int. Cl.[7] ..... A63C 5/07

[52] U.S. Cl. ..... 280/14.2; 230/602; 230/609; 230/809; 441/68

[58] Field of Search ..... 280/602, 607, 280/609, 14.2, 809, 814, 815; 441/68, 74

[56] References Cited

U.S. PATENT DOCUMENTS

| | | | |
|---|---|---|---|
| 3,260,532 | 7/1966 | Heuvel | 280/11.13 |
| 3,537,717 | 11/1970 | Caldwell | 280/11.13 |
| 3,797,839 | 3/1974 | Smolka et al. | 280/11.35 |
| 4,865,345 | 9/1989 | Piegay | 280/602 |
| 5,141,243 | 8/1992 | Meatto | 280/602 |
| 5,342,077 | 8/1994 | Abondance | 280/602 |
| 5,525,083 | 6/1996 | Reich | 441/68 |

FOREIGN PATENT DOCUMENTS

| | | | |
|---|---|---|---|
| 0 188 985 | 12/1985 | European Pat. Off. | A63C 5/07 |
| 2639242 | 5/1990 | France | 280/602 |
| 2665081 | 1/1992 | France | 280/602 |
| 2702386 | 9/1994 | France | 280/602 |
| 230 782 A1 | 12/1985 | Germany | A63C 5/07 |
| 39 19010 | 1/1990 | Germany | A63C 5/04 |
| 83/03360 | 10/1983 | WIPO | 280/602 |
| 90/03205 | 4/1990 | WIPO | 280/602 |

*Primary Examiner*—J. J. Swann
*Assistant Examiner*—F. B. Vanaman
*Attorney, Agent, or Firm*—McDermott Will & Emery

[57] ABSTRACT

A sliding apparatus includes one or more stiffening plates mounted to the top surface of the sliding apparatus. The plates serve to stiffen localized areas on the snowboard in order to change the flexion and torsion characteristics of the snowboard in that localized area. The location of the stiffening plates can be adjusted to accommodate a wide range of riding stances and orientations. The stiffening plates can be utilized on a symmetrical sliding apparatus to provide asymmetrical flexion and torsion characteristics in order to accommodate the asymmetrical stance of the rider. The stiffening plates can also be adjusted to enable a ski or snowboard to perform well in both soft snow conditions and hard packed snow conditions. The stiffening plates can be positioned within a recessed channel in the top surface of the sliding apparatus in order to prevent snow from being forced under the stiffening plates during use.

16 Claims, 15 Drawing Sheets

SLIDING APPARATUS HAVING ADJUSTABLE FLEXION AND TORSION CHARACTERISTICS

CROSS-REFERENCE TO RELATED APPLICATIONS

This application is a continuation in part of U.S. application Ser. No. 08/841,920 filed on Apr. 8, 1997 now U.S. Pat. No. 5,984,343.

STATEMENT REGARDING FEDERALLY SPONSORED RESEARCH

Not Applicable

REFERENCE TO MICROFICHE APPENDIX

Not Applicable

BACKGROUND OF THE INVENTION

The invention relates to improvements in skis, snowboards and like and more particularly, to a method and apparatus for adjusting the flexion and torsion characteristics at specific locations on the ski or snowboard.

The present invention is directed to skis and ski type devices which are used in a wide range of recreational and profession athletic endeavors, such as snow skiing and snowboarding, water skiing and even to a limited extent skateboarding. All of these activities involve an individual riding a substantially flat board, herein referred to as a ski or snowboard, across a surface. One of the challenges of these activities is the ability to control the direction of the ski at various speeds and under a wide range of conditions. Snow skiing and snowboarding are well known examples which challenge individuals on both a professional and recreational level.

Skis and snowboards are typically constructed of a wood or synthetic core material with a reinforcing material, such as an epoxy fiberglass, laminated to the core material. The type and arrangement of the reinforcing materials is selected in order to provide the desired flexion and torsion characteristics. The reinforcing material can also include well known materials such as graphite, carbon and/or KEVLAR which can be used to increase the stiffness without significantly increasing the weight of the board. The base or bottom of the ski or snowboard that rides on the snow is typically constructed of a sintered polyethylene material, sold under the trademark P-TEX, and is laminated or molded to the bottom of the reinforced core. Steel edges are secured to the lateral side edges, typically co-planar with the bottom surface of the base. Threaded inserts or a retention plate are mounted in the core to facilitate the attachment of bindings.

The top surface of the board can be completed by either adding side walls and laminating a top sheet such as ABS (Acrylonitrile Butadiene Styrene) to the top of the reinforced core (sandwich laminated construction) or by wrapping the top sheet material around the core, right to the metal edges (cap construction). Cap construction is more aesthetically pleasing and produces a board having stiffer flexion and torsion characteristics.

Snowboarding is distinguished from skiing in that snowboarding involves the use of what may be termed a single ski that is substantially wider that a traditional ski, with both feet supported on the single ski. While the skier's feet point in a direction parallel to the longitudinal axis of a conventional ski, the orientation the snowboard's feet with respect to the longitudinal axis can be varied to suit the rider and the snowboarding discipline. For example, freestyle riders typically orient their rear foot perpendicular to the longitudinal axis of the snowboard and orient their front foot pointing slightly forward at approximately 5 to 20 degrees from perpendicular to the longitudinal axis of the snowboard, and giant slalom riders typically orient both feet pointing forward by as much as 45 to 90 degrees from perpendicular to the longitudinal axis of the snowboard. Theses stances and styles are intended to facilitate control of snowboard while performing different types of snowboarding maneuvers.

A conventional skier stands facing forward and controls his or her direction by transferring weight laterally, between two edges of two separate skis. The snowboarder stands sideways, with either the left foot forward (in a regular stance) or the right foot forward (in a "goofy" stance), and controls the operation of the snowboard by applying pressure to the toe side edge or to the heel side edge, as well as by controlling the edge pressure of the front foot with respect to the rear foot. Thus the forces applied to the snowboard in carving turns are different in certain aspects from the forces applied to a pair of skis to carve the same turn.

It is generally known in the art that the performance of a snowboard or a ski is dictated by the size and shape, as well as the flexion and torsion characteristics, of the board for a given user and snow conditions. Thus, longer snowboards and skis are usually given to taller and heavier riders. Longer snowboards and skis are preferred for higher speeds and wider turning and are considered by some to be easier to use in deep snow. Shorter snowboards and skis are preferred for making quicker turns and for performing tricks. Stiffer snowboards and skis are preferred for skiing on hard packed snow and ice because they hold their edge better. Softer snowboards are preferred for skiing on fresh powder. Other characteristics such as the length and shape of the side cuts of the lateral edges also influence the performance of the snowboard or skis.

While skis tend to be symmetrical in shape with respect to their longitudinal axis, there has been a trend in snowboarding to provide a snowboard with an asymmetrical shape. The purpose of the asymmetrical shape is to accommodate the fact that the snowboarder's toes can be positioned ahead of his heels on the board. Thus, in order to provide for more even performance regardless of whether the snowboarder is making a heel side turn or a toe side turn, the heel side edge is shifted or offset toward the rear of the board.

Typically, conventional skis and snowboards are designed to perform well under a particular set of snow conditions. Thus, a professional or an expert may have several pairs of skis or snowboards including, for example, a stiffer snowboard or pair of skis for skiing on hard packed snow and a softer snowboard or pair of skis of use in soft powder. The average person who cannot afford to own more than one pair of skis or one snowboard, will only have one general purpose pair of skis or snowboard which presents a compromise in stiffness and in performance. This snowboard will not perform well on either hard packed snow or fresh powder.

There have been several attempts to provide a means for changing the flexion and torsion characteristics of skis and snowboards. U.S. Pat. No. 5,573,264 to Deville et al., discloses applying a reinforcement layer to the top of the snowboard. The flexion and torsion characteristics of the snowboard are changed by using different reinforcement materials or by adding or subtracting additional reinforcement layers. U.S. Pat. No. 4,592,567 to Sartor discloses a similar method for changing the stiffness of a snow ski, using removable battens or inserts.

One disadvantage of these prior art devices is that, like the general purpose snowboard design, they only provide for changing the flexion and torsion characteristics of the ski or snowboard by a predefined amount in a general area, typically the area in front of the binding and/or the area in back of the bindings. Thus, the rider can only influence the flexion and torsion characteristics of the ski or snowboard in a limited amount and cannot limit that influence to a particular isolated portion of the board. In addition, the limited adjustment provided by these prior art devices cannot be performed by the rider quickly and easily on the slope.

Accordingly, it is an object of this invention to provide a method and apparatus for adjusting the flexion and tension of a snowboard or ski.

It is another object of this invention to provide a method and apparatus for precisely adjusting the flexion and tension of a snowboard or ski.

It is a further object of this invention to provide a method and apparatus for quickly and easily adjusting the flexion and tension of a snowboard or ski on the slope.

It is yet another object of this invention to provide a method and apparatus for adjusting the flexion and tension of a snowboard or ski at locations along the length of the snowboard or ski.

SUMMARY OF THE INVENTION

The present invention is directed to a method and apparatus for adjusting the flexion and torsion characteristics of a skiing apparatus such as a ski or snowboard. In accordance with the invention, the skiing apparatus includes an elongated board extending along a longitudinal axis from a first longitudinal end to a second longitudinal end. The elongated board is constructed using methods known in the prior art which give the skiing apparatus its flexion and torsion characteristics which control how the skiing apparatus will perform under different conditions.

In accordance with one embodiment of the present invention, one or more stiffening elements are removably fastened to the elongated board at a first location along the length of the elongated board. The stiffening elements reinforce the elongated board at the first location and change the flexion and/or torsion characteristics of the elongated board in an area adjacent the first location. The elongated board and/or each stiffening element can be configured to permit the position of the stiffening element to be adjustable within a defined range in at least one dimension of the board in order to adjust the location at which the flexion and/or torsion characteristics of the elongated board are changed.

The stiffening element can be constructed of a flat, rigid material which increases the force required to flex or twist the skiing apparatus. Alternatively, the stiffening element can also be constructed of a curved or cambered material which can further increase the force required to flex or twist the skiing apparatus. The stiffening element can be constructed to include one or more components which damp vibration of the stiffening element during use.

The skiing apparatus can be constructed to include a recessed portion or channel in the top surface of the elongated board that extends along at least a portion of the length of the elongated board, and the stiffening element can be fastened to the elongate board in the recessed portion or channel wherein the top surface of the stiffening element is even with or below the top surface of the skiing apparatus. The location of the stiffening elements can be adjusted within the channel or recess. This avoids any interference between the stiffening elements and the bindings that secure the rider's boots to the skiing apparatus. Alternatively, the bindings can be mounted on a raised portion or an adapter element that raises the height of the bindings to avoid the interference.

In one embodiment, at least one of the stiffening elements can extend laterally or diagonally across the board from one lateral side to the other in order to change the torsion characteristics of the skiing apparatus. In this embodiment, it is possible to produce a skiing apparatus that resists torsional forces in one direction more than in another.

In another embodiment, the flexion and torsion characteristics of the skiing apparatus can be specifically designed and constructed to complement the operation of the stiffening elements in order to provide a skiing apparatus that performs well over a wide range of conditions. In this embodiment, the elongated board can be of average stiffness in the middle and be of less than average stiffness toward each end. Without the stiffening elements or with the stiffening elements located close to the middle of the elongated board, the device will perform like a relatively soft skiing apparatus, an advantage in soft snow. The stiffness of the elongated board can be increased by moving the stiffening elements toward the ends away from the middle to make the device perform more like a relatively stiff skiing apparatus an advantage in hard packed snow.

In another embodiment, softening elements can be fastened to the board in order to decrease the amount of force the rider has to apply to the board to flex the board such as while performing a turn. Thus, a relatively stiff skiing apparatus can be modified to perform better in softer snow conditions. The softening elements can be constructed of an elastomeric material that is stretched between two or more locations on the top surface of the elongated board.

The present invention also encompasses a method of changing the flexion and torsion characteristics of a skiing apparatus. The method includes the steps of providing a skiing apparatus with at least one mounting element for mounting stiffening elements to said skiing apparatus, mounting at least one stiffening element to said skiing apparatus in a first location and providing said skiing apparatus with means for adjusting the position of the stiffening elements with respect to the first location in order to adjust the location at which the change in flexion or torsion characteristics is applied.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION OF THE PREFERRED EMBODIMENTS

The present invention is directed to a method and apparatus for changing the flexion and torsion characteristics of a skiing apparatus. As used herein, the term skiing apparatus is intended to include snow skis and snowboards as well as water skis and the like. The invention can also be applied to skateboards and other similar devices as described below.

Figure 1:
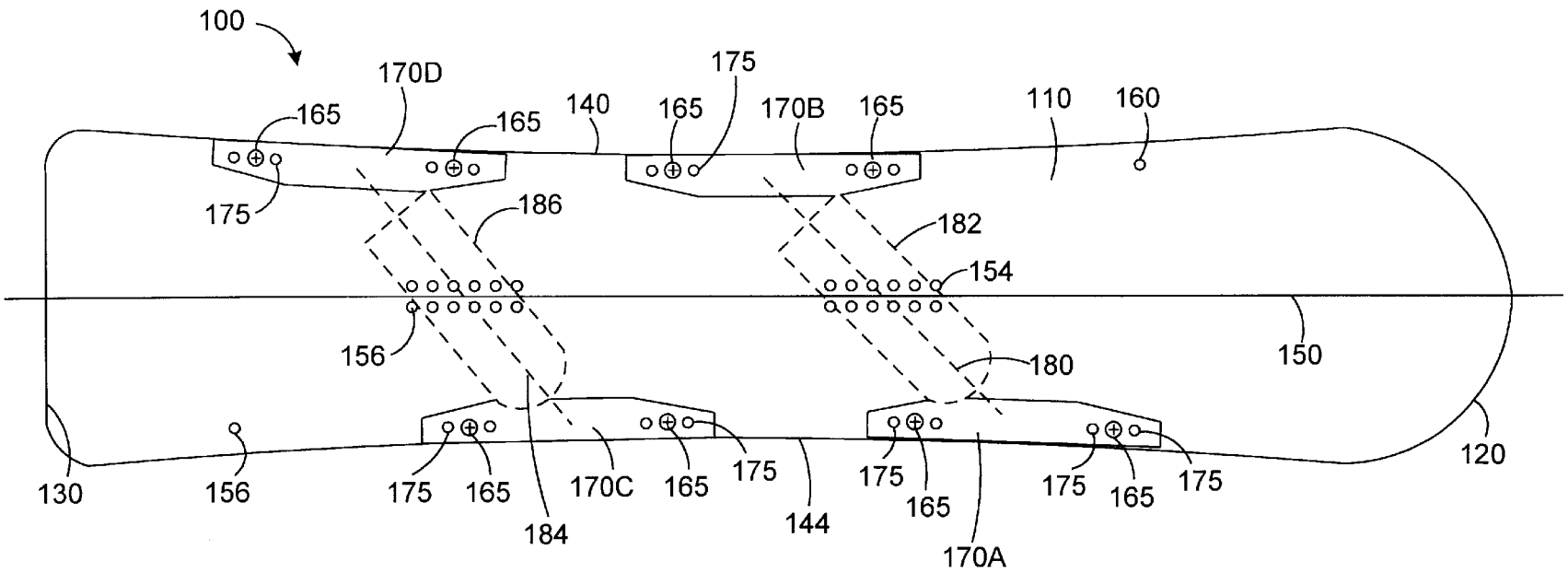
FIG. 1 is a diagrammatic top view of a snowboard in accordance with one embodiment of the present invention.

FIG. 1 shows a symmetrical alpine or freecarve snowboard 100 in accordance with one of the preferred embodiments of the present invention. The snowboard can be constructed in accordance with known prior art techniques. Preferably, the snowboard is constructed of a vertically laminated wood core having the shape of an elongated board. The top and bottom surfaces of the wood core are laminated to one or more layers of reinforcing material, such as epoxy-fiberglass, to produce a reinforced core. A base material of P-TEX is laminated or molded to bottom surface of the reinforced core, and metal edges are secured to a the bottom lateral side edges. Threaded inserts for mounting bindings are mounted in holes in the core in two locations along the central axis of the elongated board. A top sheet and side walls are added to produce a finished snowboard.

As shown in FIG. 1, the basic structure of the snowboard 100 includes an elongated, reinforced core covered on its top surface by a top sheet 110. Alpine snowboards are intended to be unidirectional; thus they have a rounded, upwardly curved front end 120 and a flatter, less upwardly curved rear end or tail 130. The lateral sides 140 and 144 extend along the length of snowboard substantially parallel to the central longitudinal axis 150 of the snowboard. The sides can curve inward in what is referred to as a side cut which corresponds directly to the radius of a turn the snowboard can make comfortably. The side cut is typically an arc having a radius ranging from approximately 800 to 1000 cm.

Located along the longitudinal axis of the snowboard 150 are front binding mounting holes 154 and rear binding mounting holes 156. The mounting holes contain threaded inserts mounted in the core and exposed by holes in the top sheet 110. The bindings (not shown) can be soft bindings, hard bindings or step-in type bindings. Typically, the orientation of each snowboard binding is adjustable from 0 degrees (wherein the rider's feet are pointing perpendicular to the longitudinal axis 150) to pointing forward by a much as 90 degrees (wherein the rider's feet are pointing forward, parallel to axis 150). Unlike conventional ski bindings, these bindings are not intended to release in the event of a fall.

In accordance with one embodiment of the present invention, additional fastening inserts 160 are added to the core. These fastening inserts 160 are located adjacent the lateral sides 140, 144 of the snowboard and are adapted to receive and engage fasteners 165 for securing stiffening plates or bars 170 to the top surface of the snowboard. Preferably, the fastening inserts 160 are located along an arc parallel to the side cut of the snowboard 100. Preferably, the stiffening plates 170 are substantially shorter and narrower than the snowboard 100 and include holes or slots 175 for receiving fasteners 165 to secure the stiffening plates 170 to the top surface of the snowboard 100. The location of the stiffening plates 170 is adjustable along the longitudinal length of the edge of the snowboard in order to adjust where the change in stiffness of the snowboard is located. Preferably, the stiffening plates 170 are constructed of a flat metal material such as steel or aluminum. Alternatively, the stiffening plates can be constructed of other known materials used in the construction of skis and snowboards such as, fiberglass, graphite, carbon and KEVLAR.

The snowboard embodying the present invention shown in FIG. 1 includes fasteners 165 that are preferably threaded bolts having either a flat, recessed head or a low profile head. Each fastener 165 is inserted through a hole 175 in the stiffening plate 170 and engage mating threads in fastening inserts 160 in order to contribute to the secure fastening of the stiffening plates 170 to the snowboard 100 in order to prevent any movement of the stiffening plates 170 with respect to the top surface of the snowboard 100 during the most aggressive snowboarding maneuvers.

The position of the stiffening plates 170 is adjusted to suit the personal requirements of the rider. Because the rider's weight is distributed between his or her two feet, the pressure applied to the snowboard 100 is localized at the edges in the areas adjacent the toes and heels. Thus, the rider may be unable to fully utilize the entire length of the edge in executing a turn because board will flex more at the areas of localized pressure and thus, only these areas will be used to execute a turn. In addition, the position of the high pressure areas along the edges of a particular snowboard can vary greatly from one rider to the next due to their differing physical characteristics such as height and weight, the location and orientation of their feet and their riding style. If the pressure can be more evenly distributed along the edge of the snowboard, the rider will have better control.

A snowboard embodying the present invention provides a means for more evenly distributing the pressure along the edge of the snowboard. This is accomplished by aligning the stiffening plates 170 with the axis of the feet to stiffen the area of localized pressure and more evenly distribute that pressure along the edge of the board. As shown in FIG. 1, the front foot 182 is oriented at an angle of 45 degrees (with respect to perpendicular to the longitudinal axis 150 of the snowboard) and the rear foot 186 is oriented at an angle of 40 degrees. Thus the front toe side stiffening plate 170A and the front heel side stiffening plate 170B are approximately centered with respect to the axis of the front foot 180 and the rear toe side stiffening plate 170C and the rear heel side stiffening plate 170D are approximately centered with respect to the axis of the rear foot 184. In one preferred embodiment, the rider's bindings or boots can bear directly on the stiffening plates 170.

In addition, the snowboard can be tuned further to accommodate the skill and style of the rider. By moving the front stiffening plates 170A, 170B forward or by using longer stiffening plates, the front of the board can be made stiffer to make the snowboard respond quicker and perform more aggressively. By moving the rear stiffening plates 170C, 170D rearward, the tail of the board can be made stiffer to make the snowboard spring out of a turn faster. Conversely, by moving the front stiffening plates 170A, 170B rearward and rear stiffening plates 170C, 170D forward, the snowboard will be generally softer and perform better in softer snow conditions. Furthermore, because the stiffening plates 170 are independently adjustable, the performance of the heel side edge and the toe side edge can be separately adjusted to accommodate the level skill of the rider which can be different from the toe side to the heel side. Plates of different thickness or stiffness can be provided to accommodate riders of different heights and weight.

Figure 2:
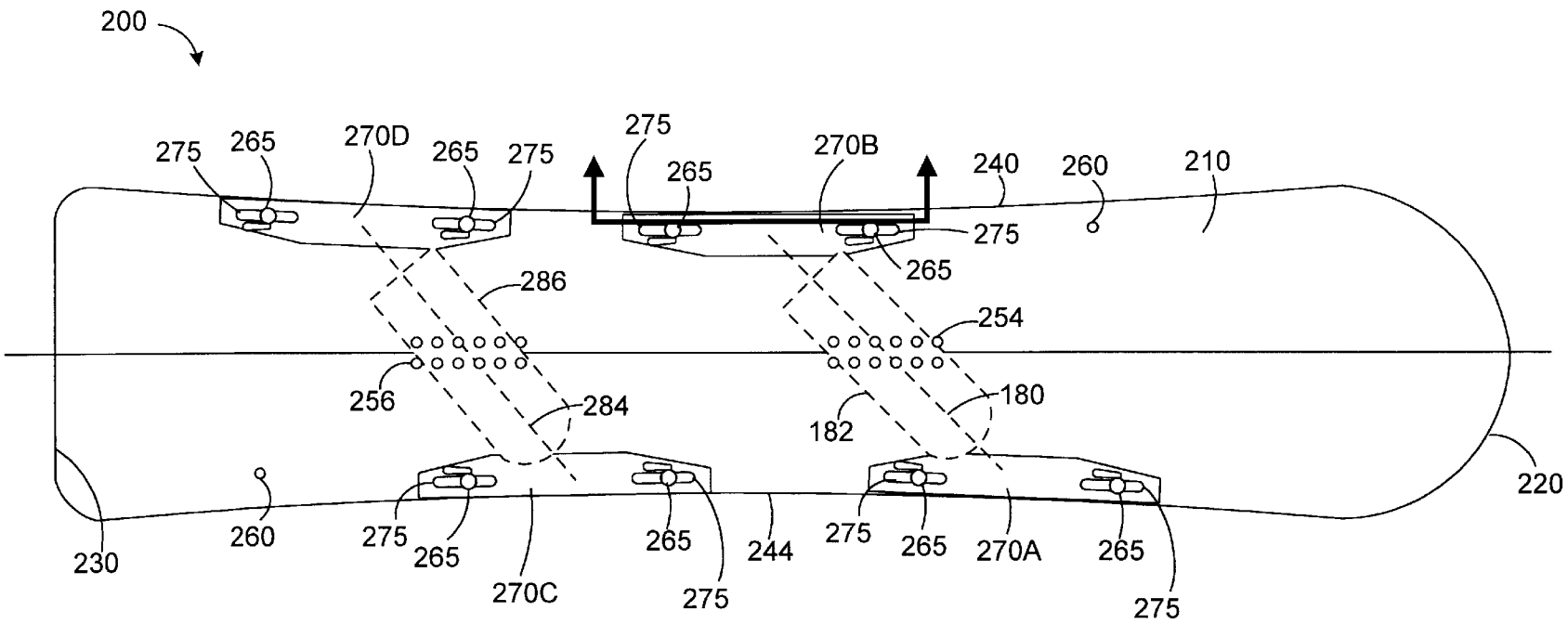
FIG. 2 is a diagrammatic top view of a snowboard in accordance with another embodiment of the present invention.

FIG. 2 shows a symmetric alpine or freecarve snowboard in accordance with an alternative embodiment of the present invention. The structure of the snowboard 200 shown in FIG. 2 can be the same as that of the snowboard shown in FIG. 1. It includes an elongated board 200 extending along a longitudinal axis 250 having a top sheet 210, an upwardly curved front end 220, a rear end or tail 230, lateral sides 240, 244, and inserts 254 and 256 for mounting bindings (not shown). Additional fastening inserts 260 are also provided at locations adjacent the lateral sides 240, 244 of the snowboard 200 and are adapted to receive quick release fasteners 265 for securing stiffening plates or bars 270 to the top surface of the snowboard. The quick release fasteners 265 engage the stiffening plates 270 in slots 275 in order to securely fasten the stiffening plates 270 to the top surface of the snowboard 200. The quick release fasteners 265 also include a release lever to release the stiffening plates 270 in order to permit adjustment in accordance with the present invention.

The quick release fastener 265 can be similar to those used in the bicycle industry to lock the axle of a wheel into the frame. The quick release fasteners 265 typically include a pin or shaft that is threaded into fastening inserts 260 and a lever and cam arrangement that can apply a clamping pressure on the stiffening plates 270. Alternatively, the quick release fasteners 265 can be a bayonet mounted pin that engages a complementary socket in the fastening insert 260. The bayonet pin can be released to allow adjustment of the stiffening plates by a turning it a quarter turn and the pin can be removed to allow the plates to be interchanged by turning it another quarter turn. In another embodiment, a nut, bayonet socket or bolt head can be captivated in a track mounted in the top surface of the snowboard. The nut, bayonet socket or bolt head could be permitted to move along the length of the track in order to adjust the position of stiffening plate and a complementary fastener or quick release fastener could be provided to securely fasten the stiffening plate to the track mounted in the snowboard.

Figure 3:
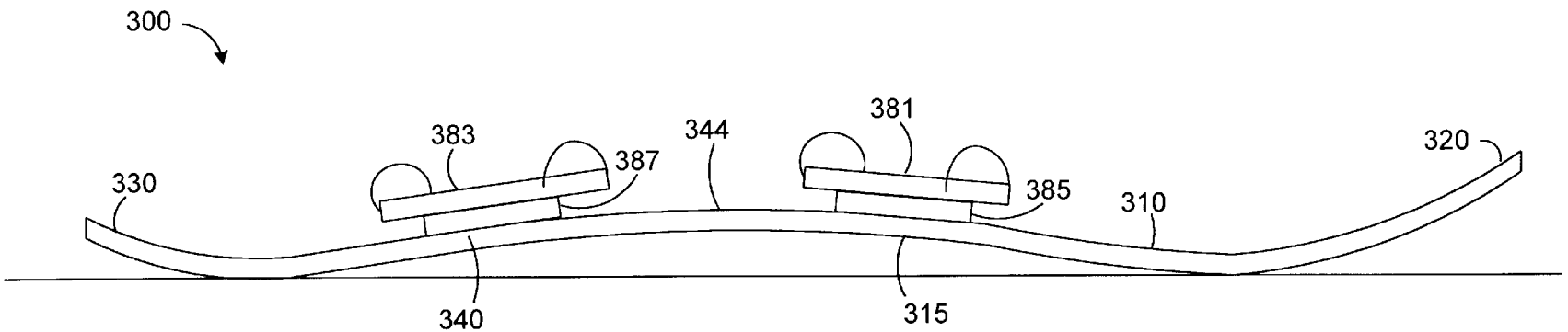
FIG. 3 is a diagrammatic side view of a snowboard in accordance with an alternative embodiment of the present invention.

FIG. 3 shows a side view of a symmetrical alpine or free carve snowboard 300 in accordance with one embodiment of the present invention. The thickness of the features in FIG. 3 has been exaggerated to facilitate an understanding of the description. The structure of the snowboard 300 shown in FIG. 3 can be the same as that of the snowboard shown in FIGS. 1 and 2. It includes an elongated board 300 having a top sheet 310, a base 315, an upwardly curved front end 320, a rear end or tail 330, lateral sides 340, 344, and bindings 381 and 383. Because the stiffening plates (not shown) can be positioned on the top surface of the snowboard adjacent or under the rider's toes or heels, there is a possibility that the stiffening plates could interfere with the rider's bindings or interfere with the rider's boots by preventing the rider from fastening his or her boots in the bindings. Thus, in accordance with the invention, the bindings 381, 383 can be mounted on adapter plates 385, 387 which can raise the rider's bindings or boots above the level of the stiffening plates. Adapter plates 385 and 387 can be mounted to the snowboard mounting holes and the bindings 381, 383 mounted to the adapter plates 385, 387 or the adapter plates 385, 387 can function as a spacer for bindings to raise the binds 381, 383 the thickness of the adapter plates 385, 387 above the top surface of the snowboard. In one embodiment, the rear adapter plate 387 can be thicker than the front adapter plate 385 to give the rider additional forward lean. Alternatively, the top surface of each adapter plate can be inclined with respect to the bottom surface to give the rider's boots a slight incline.

Figure 4:
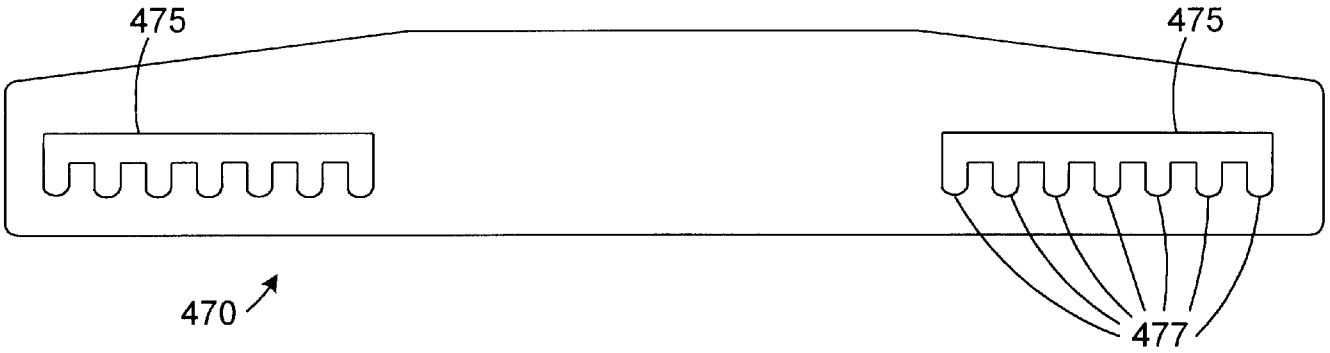
FIG. 4 is a diagrammatic view of a stiffening plate in accordance with an alternative embodiment of the present invention.

FIG. 4 shows a stiffening plate 470 in accordance with an alternative embodiment of the invention. The stiffening plate 470 includes slot 475 having a plurality of notches 477. The notches 477 engage the pin of quick release fastener (not shown) to prevent the stiffening plate 470 from moving longitudinally with respect to the snowboard. The length of notches 477 can be selected to allow the lateral position of the stiffening plates 470 to be adjusted as well.

Figure 5:
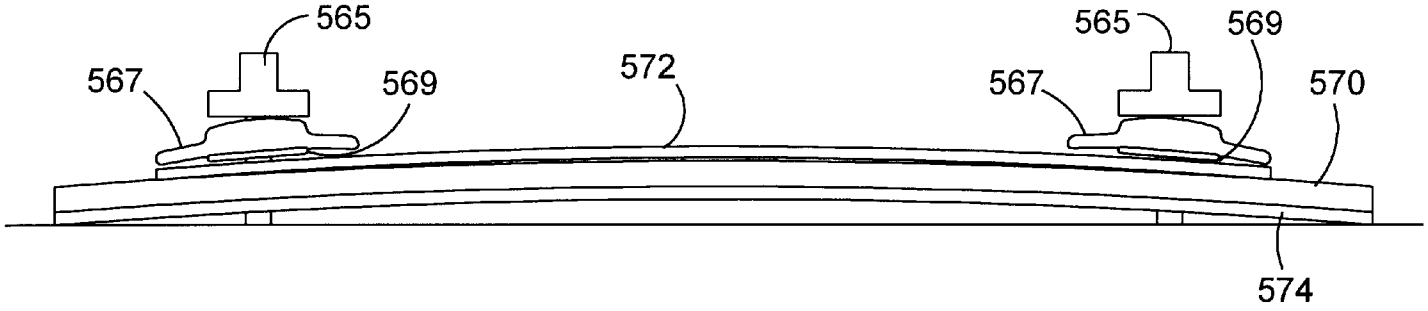
FIG. 5 is a diagrammatic side view of a stiffening plate in accordance with an alternative embodiment of the present invention.

FIG. 5 shows a side view of a stiffening plate 570 in accordance with an alternative embodiment of the invention. As shown in FIG. 5, each stiffening plate 570 can be curved or provided with a slight upward camber. This camber increases the stiffening effect of the stiffening plates 570. The stiffening plates 570 can also be provided with reinforcing layer 572, such as a fiberglass, graphite, carbon or KEVLAR material. In addition, the fibers can be arranged and oriented to provide predetermined flexion and torsion characteristics of the stiffening plates 570.

Also shown in FIG. 5, the stiffening plates 570 can be provided with a layer of vibration damping material 574 positioned between the stiffening plate and top sheet. In one preferred embodiment of the invention, the entire stiffening plate 570 is coated with a thermoplastic elastomer material such as low density polyurethane, PVC, or natural rubber. One preferred material is HYTREL polyester elastomer available from Du Pont Plastics of Wilmington, Del. This coating not only provides further vibration damping, it serves to protect the stiffening plates from the elements, provides a high friction interface between the stiffening plate and the snowboard that helps to prevent the stiffening plate 570 from moving with respect to snowboard when fastened and helps to prevent snow and ice from building up under the stiffening plates.

FIG. 5 also shows an alternate method of fastening the stiffening plates 570 to the snowboard. In this embodiment, the threaded fastener 565 includes a T shaped head to facilitate turning and a spring plate 567 to facilitate fastening. The spring plate 567 can be a curved plate made from a spring material such as spring steel that provides pressure between the head of the fastener 565 and the stiffening plate 570. The spring plate 567 can further include a vibration damping material 569, such as one of the materials discussed above, between the spring plate 567 and the stiffening plate 570 to further damp vibration of the stiffening plates.

Alternatively, the spring plate 567 can also be coated with a thermoplastic elastic material as discussed above.

Figure 6A:
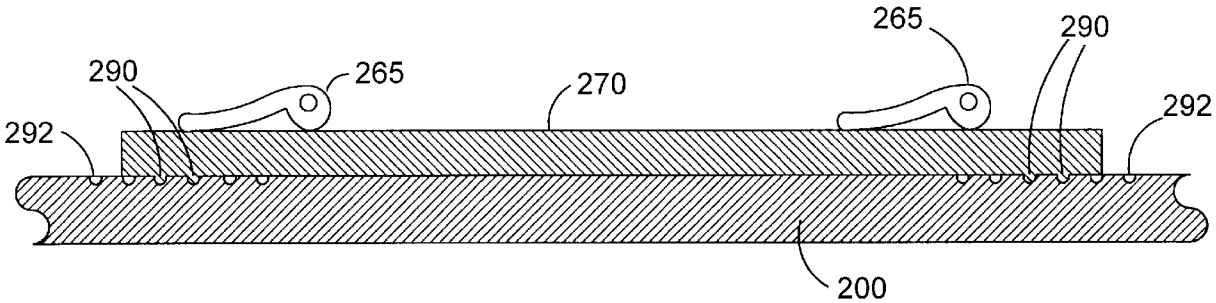
FIGS. 6A–6C show a sectional view of a portion of the snowboard shown in FIG. 2.
Figure 6B:
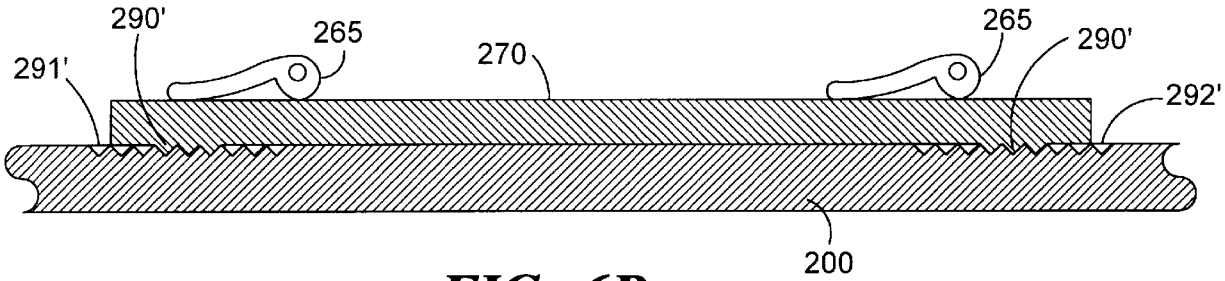
Figure 6C:
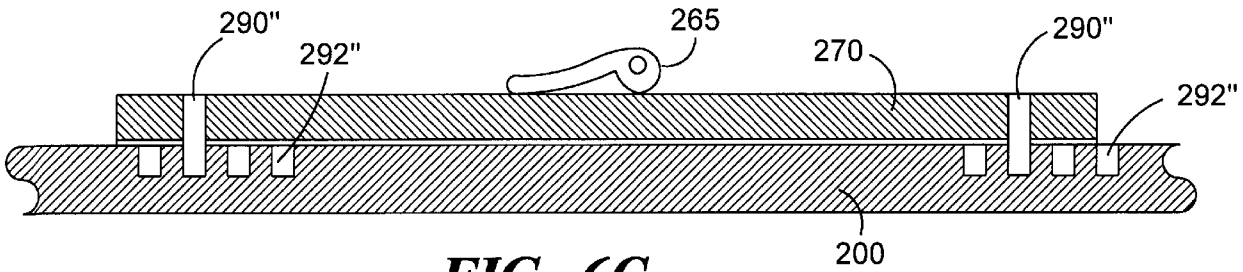

FIGS. 6A through 6C show alternative means for preventing relative movement of the stiffening plates with respect to the snowboard. In accordance with one embodiment of the invention, it has been recognized that the use of a quick release mechanism may not entirely prevent the bottom surface of the stiffening plate from moving relative to the top surface of the snowboard during use because of the significant forces generated. This relative movement can reduce the stiffening function of the plates and can cause wear on the stiffening plates and the top sheet of the snowboard.

FIG. 6A shows a section view of one embodiment of the stiffening plate of FIG. 2. The stiffening plate 270 includes one or more bumps or protrusions 290 that extend into complementary shaped dimples or depressions 292 in the top surface of the snowboard 200. Thus, when the stiffening plate 270 is locked down by two quick release fasteners 265, the bumps 290 and dimples 292 are engaged to prevent the stiffening plate 270 from moving relative to the snowboard 200.

FIG. 6B shows a section view of an alternative embodiment of the stiffening plate of FIG. 2. The stiffening plate 270 includes one or more transverse ridges 290' that engage transverse grooves 292' in the top surface of the snowboard 200. Thus, when the stiffening plate 270 is locked down by two quick release fasteners 265, the transverse ridges 290' and the transverse grooves 292' interlock and prevent the stiffening plate 270 from moving relative to the snowboard 200.

FIG. 6C shows a section view of an alternative embodiment of the stiffening plate of FIG. 2. The stiffening plate 270 includes one or more pins 290" that engage holes 292" in the top surface of the snowboard 200 and is fastened by a single centrally located quick release fastener 265. Thus, when the stiffening plate 270 is locked down by the quick release fastener 265, the pins 290" are aligned in the holes 292" to prevent the stiffening plate 270 from moving relative to the snowboard 200.

In an alternative embodiment of the invention, the quick release fastener can include a portion that is presses against the stiffening plate to hold it in place. The portion that pressed against the stiffening plate can include a feature such as a bump or a ridge that engages a complementary dimple or groove in the stiffening plate to prevent relative movement of the stiffening plates with respect to the snowboard. This feature can be utilized in addition to or instead of the features shown in FIGS. 6A–6C.

Figure 7:
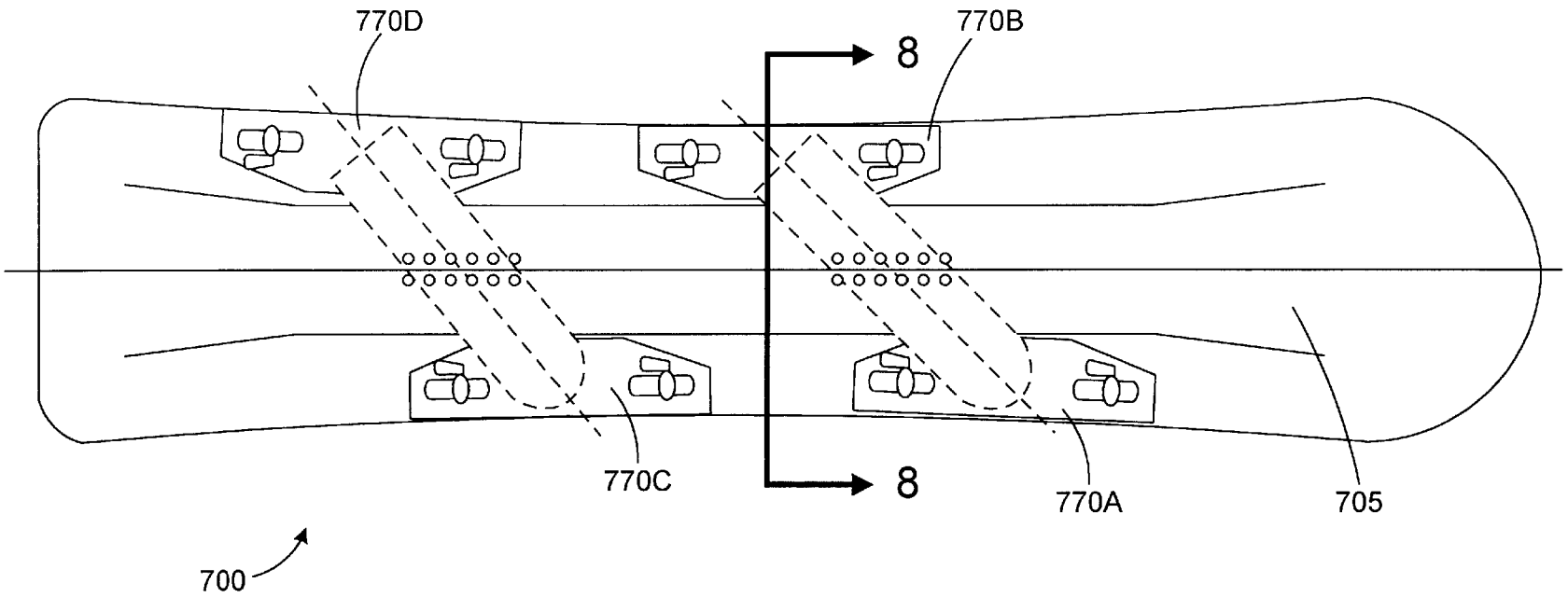
FIG. 7 is a diagrammatic view of a snowboard in accordance with an alternative embodiment of the present invention.
Figure 8:
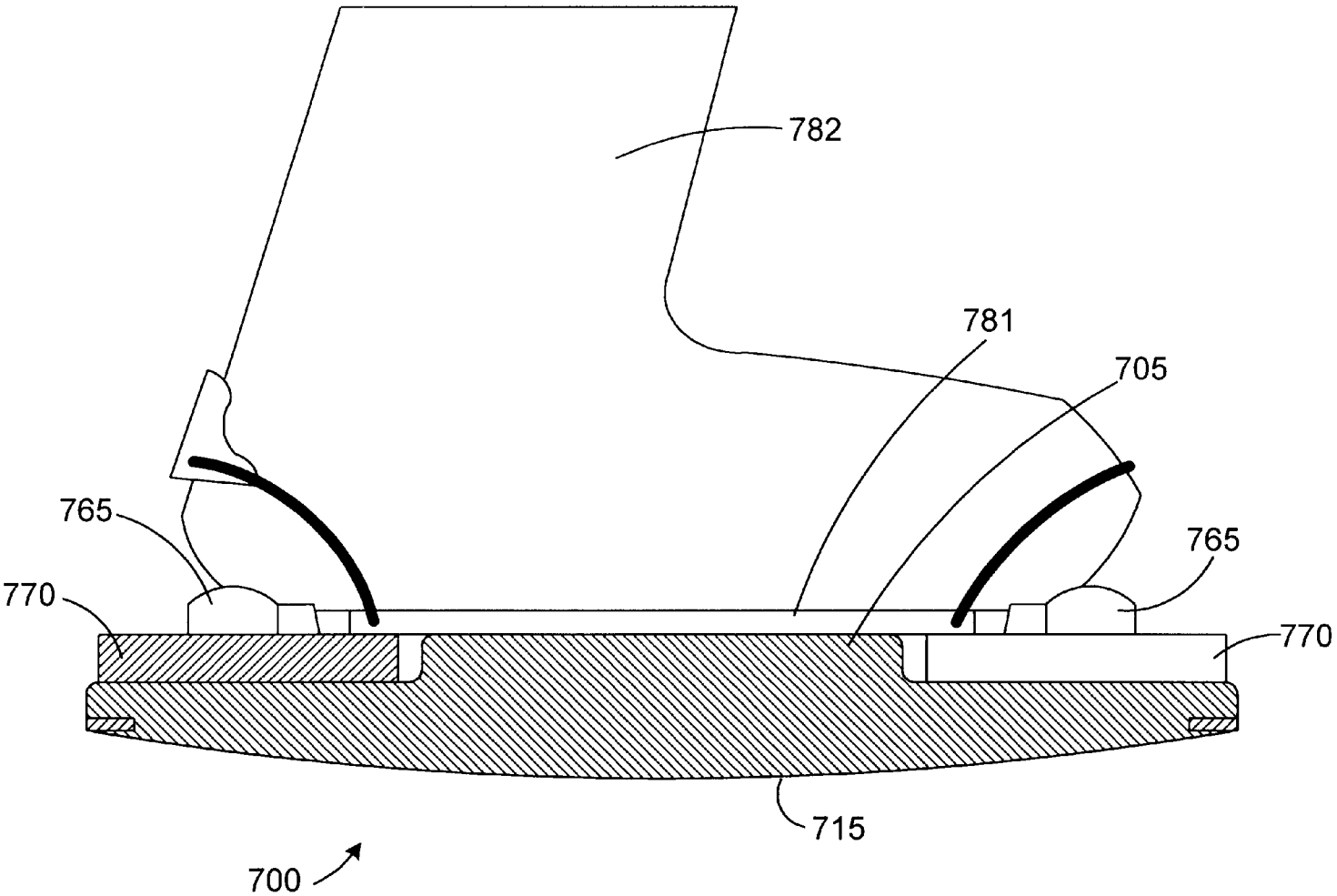
FIG. 8 is a sectional view of a portion of the snowboard shown in FIG. 7.

FIGS. 7 and 8 show an alternate embodiment of the present invention, wherein the snowboard 700 includes a central ridge or spine 705 instead of an adapter plate to raise the bindings above the top surface of the stiffening plates 770. Thus, the stiffening plates 770 are located in a channel or recess in the surface of the snowboard. FIG. 8 shows a section view through the waist of the snowboard 700 and shows how the binding 781 and the boot 782 is mounted to the central ridge 705. The binding 781 is raised above the top surface of the stiffening plates 770 and the quick release fasteners 765 are located in positions that do not interfere with the boots 782 or bindings 781.

In accordance with the alternative embodiment, FIG. 8 shows that the binding 781 can bear directly on the stiffening plate 770. In this embodiment, one or both bindings could bear against the stiffening plate. This permits the rider to control the pressure distributed along the edge of the snowboard which improves control. Alternatively, one or both of the rider's boots could bear directly on the stiffening plates to control the pressure applied to the edges of the snowboard to enhance control. The rider's boots and/or bindings can be configured to interact with the stiffening plates to optimize and enhance the rider's ability to apply pressure to the edge of the snowboard.

FIG. 8 also shows an alternative embodiment wherein the bottom of the snowboard 715 is slightly convex along the central axis of the snowboard. In this embodiment, the snowboard has improved speed and control performance on soft or wet snow.

Figure 9A:
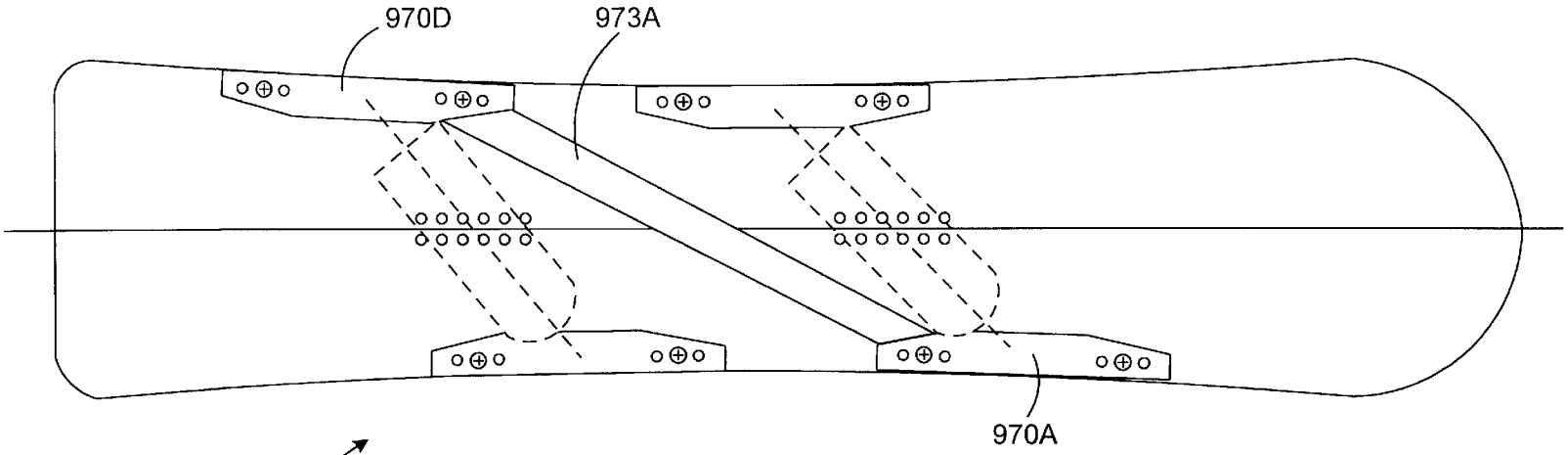
FIGS. 9A and 9B show a diagrammatic view of a snowboard in accordance with an alternative embodiment of the present invention
Figure 9B:
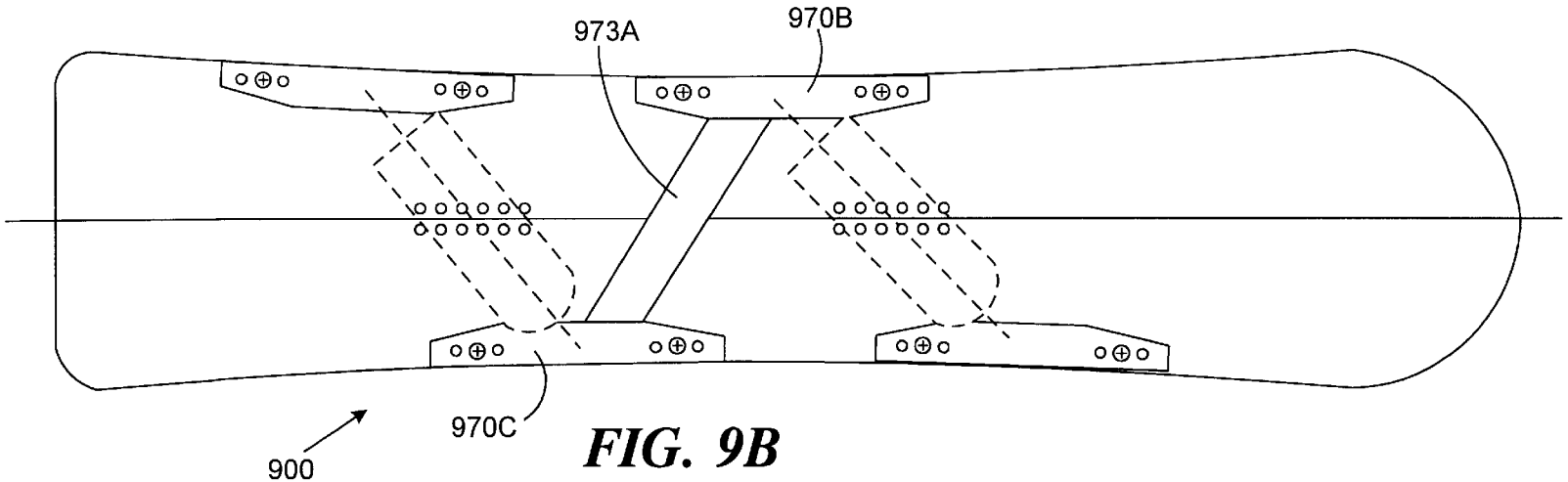

FIGS. 9A and 9B show an alternative embodiment of the present invention wherein the stiffening plates 970 include a torsional stiffening plate 973 that extends laterally across the width of the snowboard. This embodiment provides torsional stiffening as well as longitudinal stiffening along the edges. FIG. 9A shows one embodiment wherein the front toe stiffening plate 970A is interconnected with the rear heel stiffening plate 970D by torsional stiffening plate 973A. FIG. 9B shows an alternative embodiment wherein the front heel stiffening plate is interconnected with the rear toe stiffening plate 970C by torsional stiffening plate 973B. In this embodiment, the torsional stiffening plate 973 can be integral with the stiffening plates 970 or the torsional stiffening plate 973 can be a separate plate that is securely fastened to the stiffening plates 970.

Figure 10:
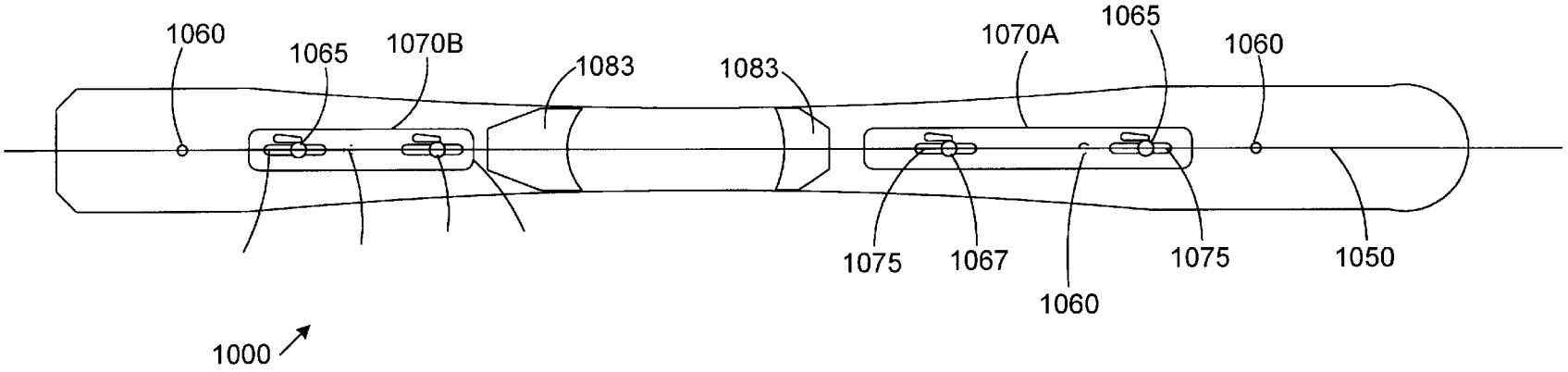
FIG. 10 is a diagrammatic view of a ski in accordance with the present invention.

FIG. 10 shows a ski 1000 in accordance with an alternative embodiment of the present invention. The ski 1000 is constructed in accordance with known prior art methods. In a manner similar to the snowboard shown in FIGS. 1 and 2, the ski 1000 includes a plurality of fastening inserts 1060 mounted in the core of the ski 1000 and are adapted for receiving fasteners 1065 which securely fasten stiffening plates 1070 to the ski 1000. Preferably, the stiffening plates 1070 are substantially shorter than the ski 1000 and include holes or slots 1075 for receiving fasteners 1065 to secure the stiffening plates 1070 to the top surface of the snowboard 1000. The location of the stiffening plates 1070 is adjustable along the longitudinal length of the ski in order to adjust where the change in stiffness of the ski is located. Alternatively, stiffening plates can be placed along the edges of the ski and adjacent the rider's bindings in a manner similar to that shown in FIGS. 1–9.

This embodiment provides for a ski that can be adjusted to perform well over a wider range of snow conditions than conventional skis. With stiffening plates located close to the skier's binding, the ski be softer and more flexible and will perform better in soft snow conditions, whereas with the plates moved away from the binding the ski will be stiffer and will perform better in harder snow conditions. This embodiment allows ski areas and rental shops to stock a single type of ski to accommodate a wide range of snow conditions and skier skill levels. Beginning skiers can be given softer skis and the plates can be added or adjusted to stiffen the ski in order to provide a more responsive and advanced performance as the skier's ability increases.

Figure 11:
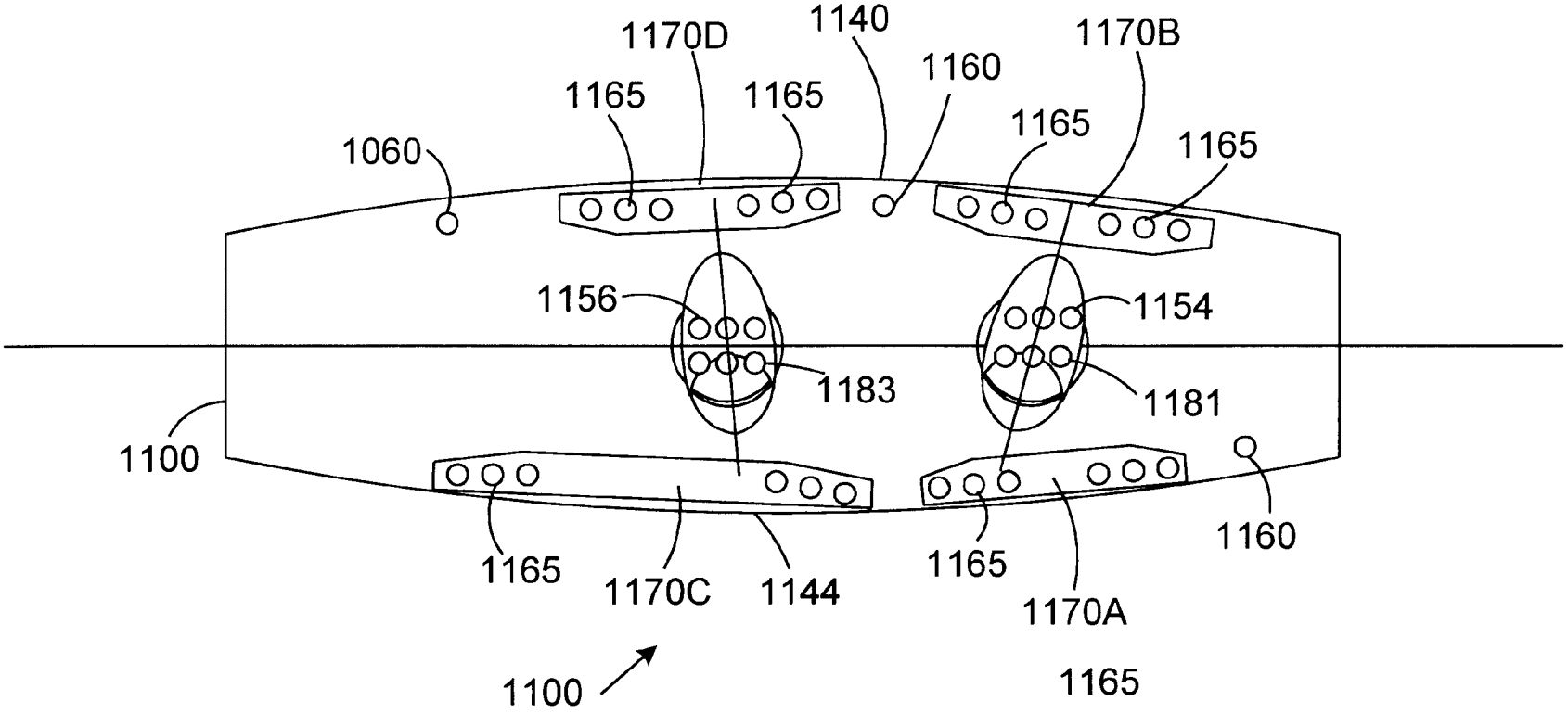
FIG. 11 is a diagrammatic view of a wake board water ski in accordance with the present invention.

FIG. 11 shows a wakeboard type water skiing device in accordance with an alternative embodiment of the present invention. The wakeboard 1100 is constructed of a substantially flat board extending along a longitudinal axis 1150 from a first end 1120 to a second end 1130. Preferably, the wakeboard 1100 is slightly wider in the middle and narrowest near the ends, thus the lateral sides 1140 and 1144 bow outward. The wakeboard 1100 is constructed with threaded inserts 1154, 1156 mounted to the core along the central portion of the board in order to facilitate mounting bindings 1181, 1183 to the top surface. In accordance with the invention, additional fastening inserts 1160 are mounted in the core of the wakeboard 1100 adjacent the lateral side edges 1140, 1144. The fastening inserts 1160 are adapted to receive fasteners 1165 for securing stiffening plates 1170 to the wakeboard 1100. The location of the stiffening plates 1170 is adjustable along the longitudinal length of the edge of the wakeboard 1100 in order to adjust where the change in stiffness of the wakeboard 1100 is located.

Figure 12:
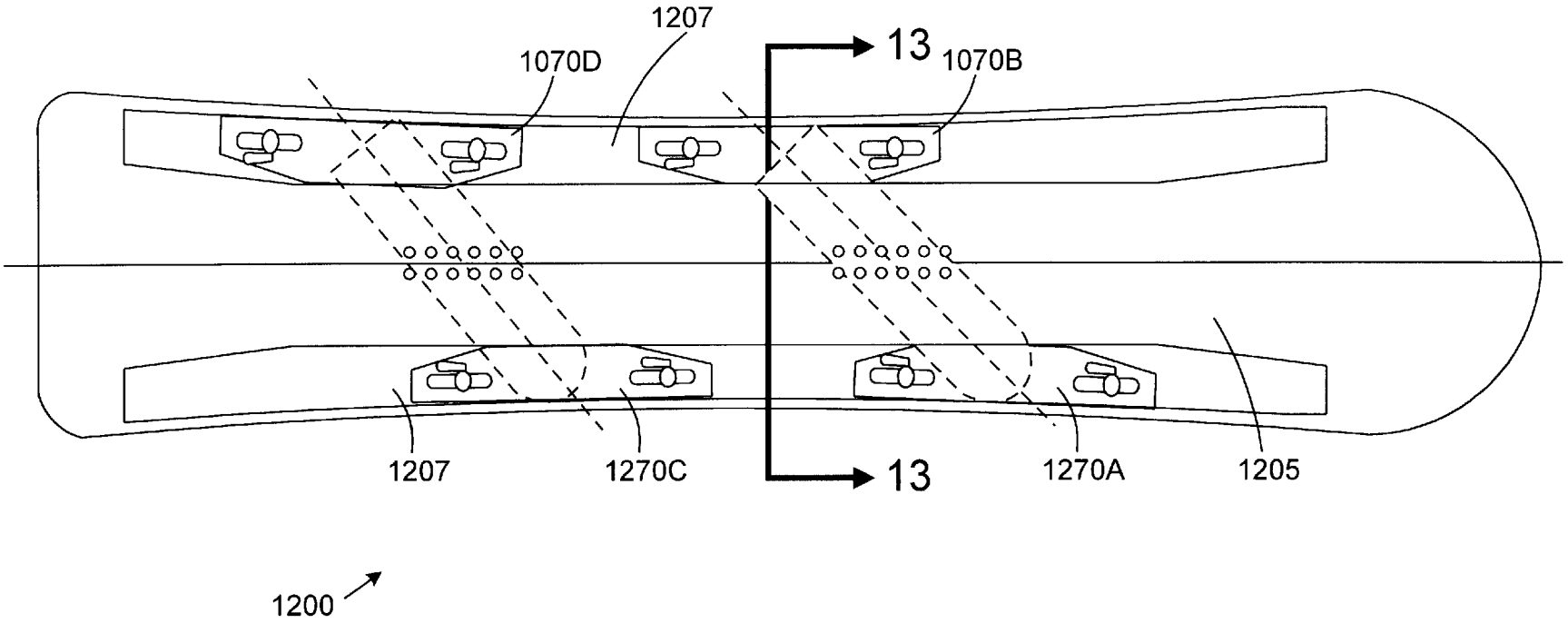
FIG. 12 is a diagrammatic view of a snow board according to an alternate embodiment of the present invention.
Figure 13:
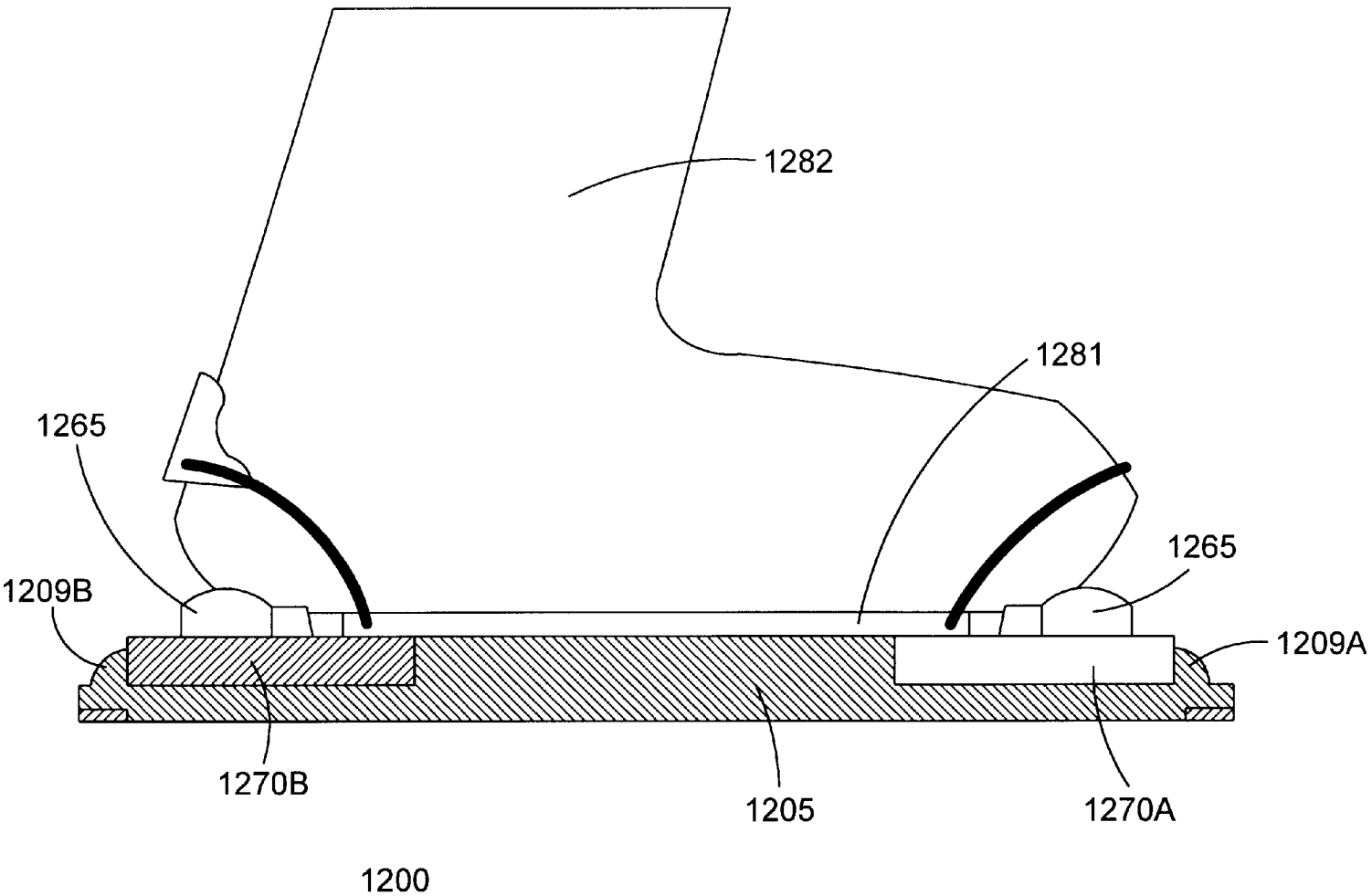
FIG. 13 is a diagrammatic section view through lines 13—13 of the snowboard shown in FIG. 12.

FIGS. 12 and 13 show a snowboard 1200 in accordance with an alternative embodiment of the present invention similar to the embodiment shown in FIGS. 7 and 8. In this embodiment, the snowboard 1200 includes a central ridge or spine 1205 and a pair of side shoulders 1209A and 1209B that form a pair of recessed channels 1207 that extend along the length of the snowboard 1200. The stiffening plates 1270A, 1270B, 1270C, 1270D can be fastened in the recessed channel by any of the previously mentioned fastening elements 1265. The side shoulders 1209A and 1209B help to position the stiffening plates 1270A, 1270B, 1270C, 1270D along the edge of the snowboard 1200 and prevent snow from being forced under the stiffening plates 1270A, 1270B, 1270C, 1270D during use.

Preferably, the height of each of the side shoulders 1209A, 1209B is as high or slightly lower than the stiffening plates in order to prevent the toes and the heels of the rider from bearing on the side shoulders 1209A and 1209B. Better performance of the stiffening plates on the snowboard is achieved when the toes and heels of the rider bear directly on the stiffening plates, thus it is desirable to configure the bindings (and both feet orientations), the stiffening plates 1270, the side shoulders 1209 and central ridge 1205 accordingly.

Figure 14:
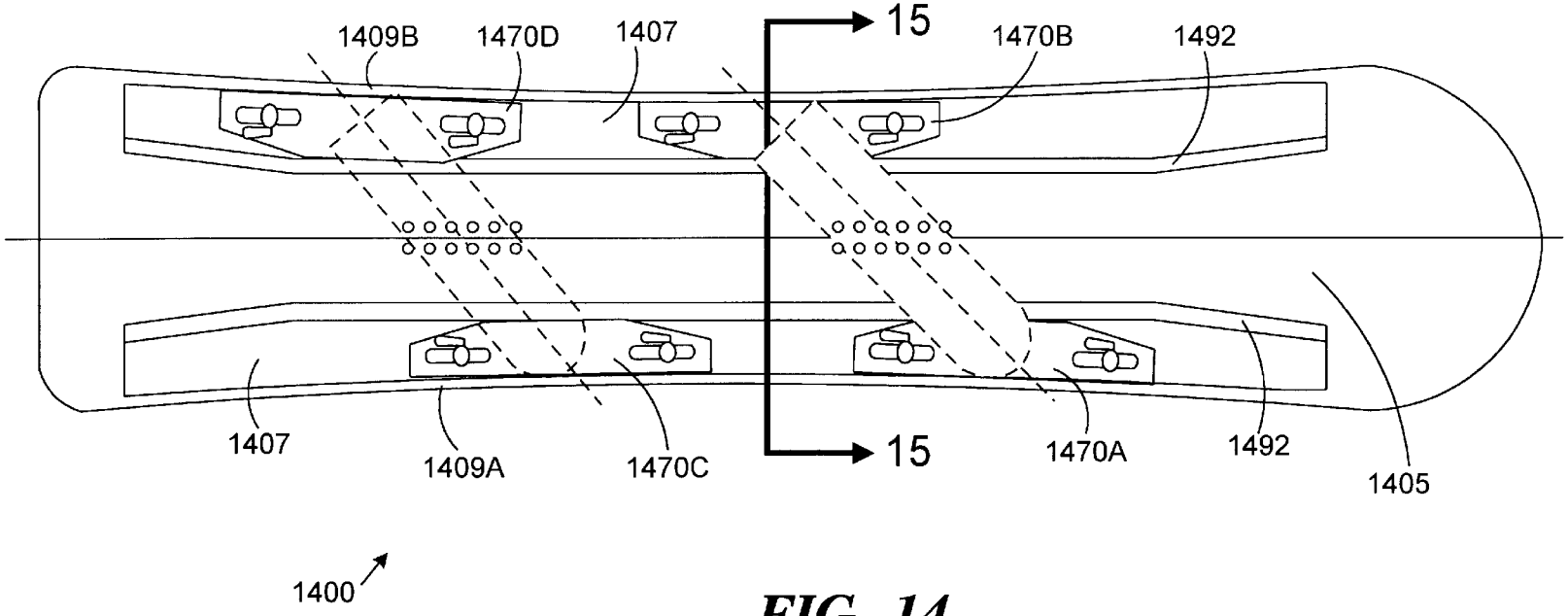
FIG. 14 is a diagrammatic view of a snow board according to an alternate embodiment of the present invention.
Figure 15:
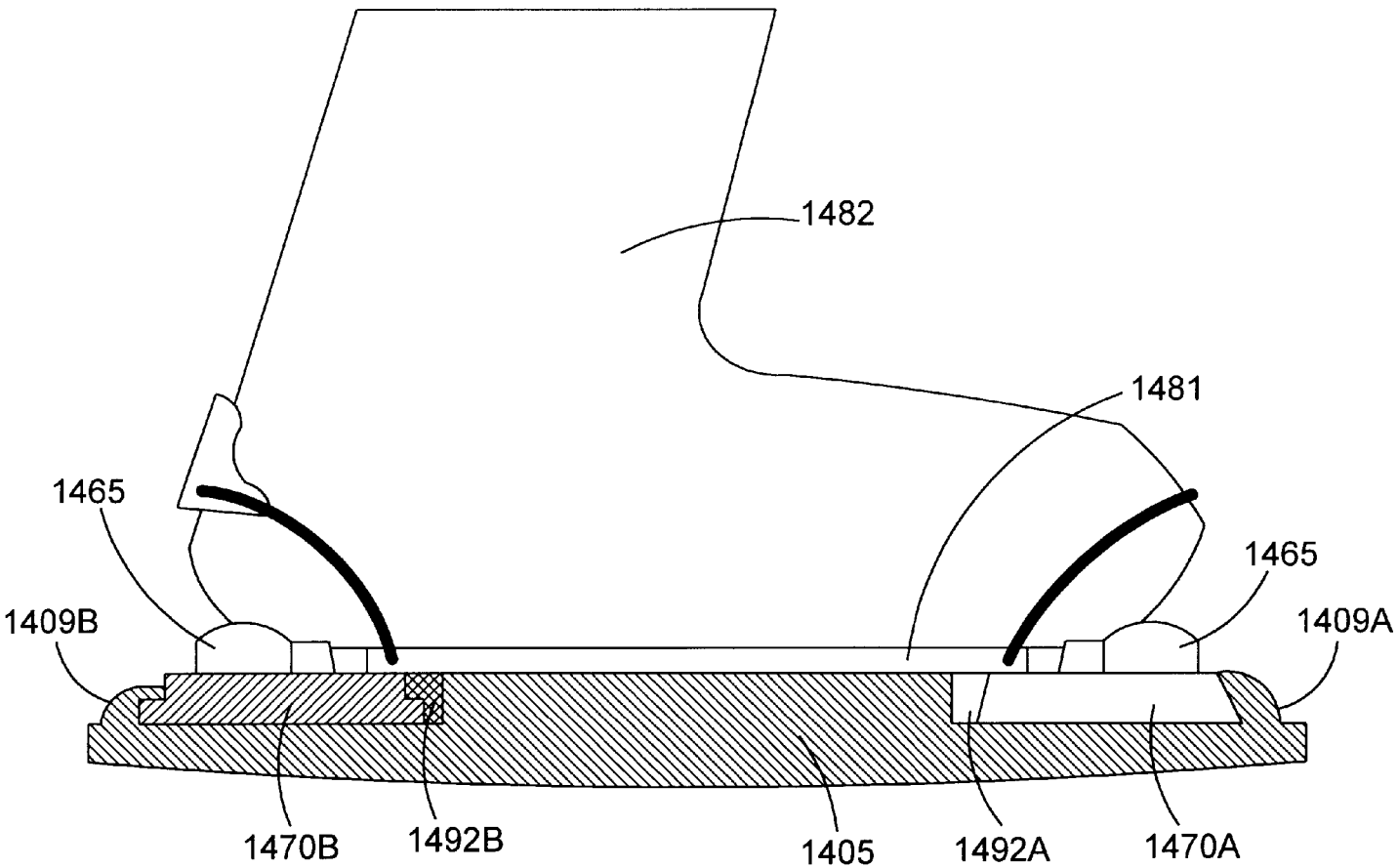
FIG. 15 is a diagrammatic section view through lines 15—15 of the snowboard shown in FIG. 14.
Figure 16:
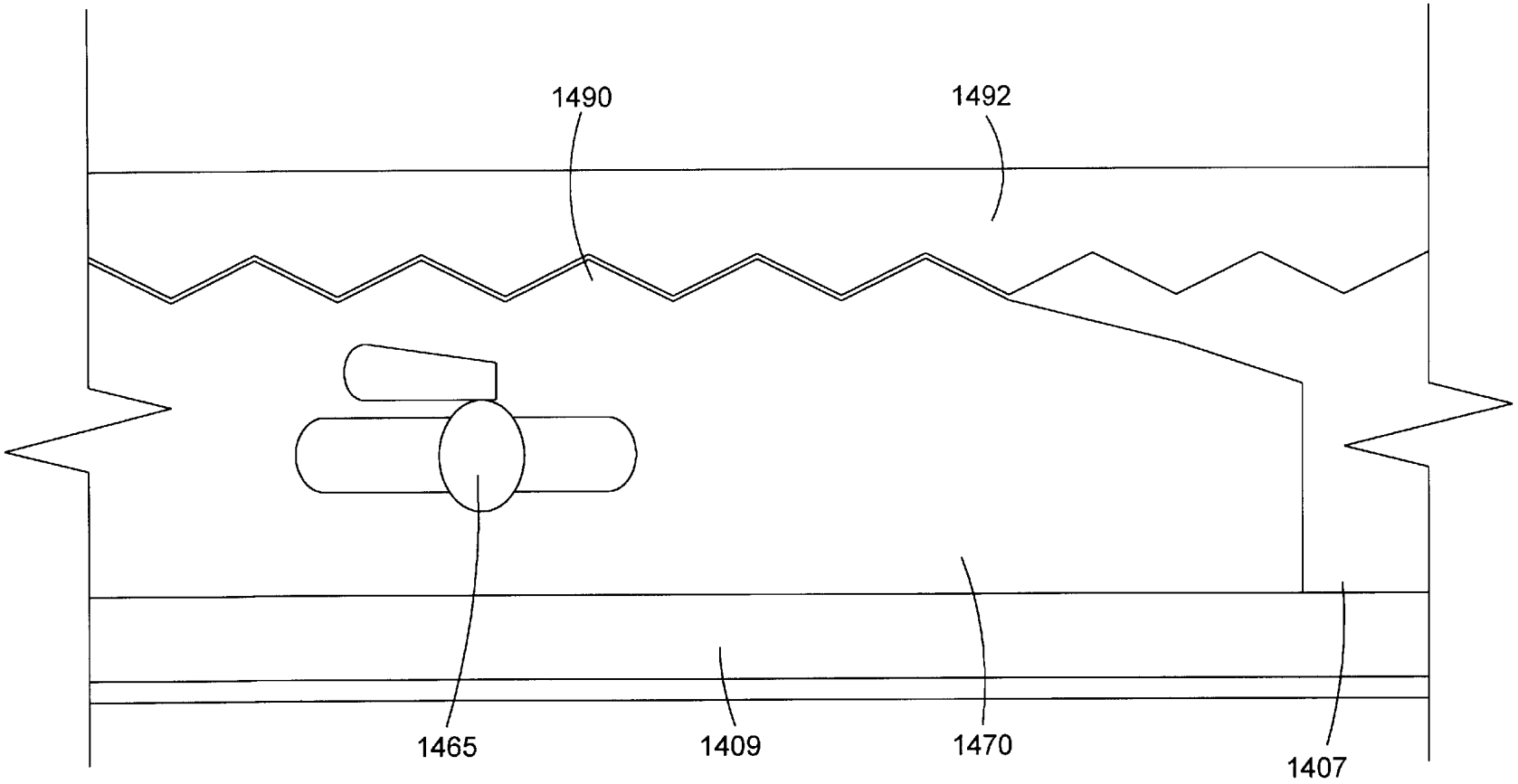
FIG. 16 is a diagrammatic detail view of the snowboard shown in FIGS. 14 and 15.

As shown in FIGS. 14, 15 and 16, the recessed channels 1407 can also include retaining elements 1492 which include a mating or interlocking portion which engages a complementary mating or interlocking portion 1490 of the stiffening plates 1470A, 1470B, 1470C, 1470D and prevents the stiffening plates 1470A, 1470B, 1470C, 1470D from moving longitudinally with respect to the snowboard 1400. Preferably, the retaining elements 1492 are fastened to snowboard 1400 against the central ridge 1405 and have teeth that project into the recessed channel and engage similar teeth 1490 projecting from the stiffening plates 1470A, 1470B, 1470C, 1470D. Alternatively, the retaining elements 1492 can be formed integral to the surface of the snowboard. As one having ordinary skill in the art will appreciate, any interlocking pattern can be utilized to prevent the stiffening plates from moving relative to the snowboard 1400.

As shown in FIG. 15, the engaging surfaces of the stiffening plates 1470A and the retaining elements 1492A can be angled with respect to the plane of the snowboard. By angling the retaining element 1492A over the stiffening plate 1470A as shown in FIG. 15, the retaining element 1492A can be used to hold the stiffening plate 1407A in place. In one embodiment, the stiffening plate 1470A can be angled on both sides which are adapted to mate with complementary angled portions of the side shoulder 1409A and complementary angled portions of the retaining element 1492A to fasten the stiffening plates in place with or without the fastening elements 1465. Alternatively, a tongue and groove construction can be used whereby a tongue on each side of the stiffening plate 1470B can mate with a complementary groove in the side shoulder 1409B and a complementary groove formed by the retaining element 1492B. As one of ordinary skill will appreciate, other interlocking complementary surface configurations can be used.

One of the benefits of the invention is that it can be applied to new skis and snowboards as well as to older devices. Thus, existing skis and snowboards can be retrofitted to accept stiffening plates utilizing a kit in accordance with the present invention. The kit can include a plurality of the fastening inserts that can be mounted into the core of the ski or snowboard and a set of stiffening elements and fasteners such as quick release fasteners to secure the stiffening plates to the ski or snowboard. The process for retrofitting a ski or snowboard involves the steps of locating and mounting the fastening inserts into the core of the ski or snowboard at appropriate locations thereof and fastening the stiffening plates in accordance with the invention.

In an alternative embodiment, the skiing apparatus such as the ski or snowboard can be designed and constructed to have flexion and torsion characteristics that complement the operation of the stiffening elements, in order to produce a single skiing apparatus that performs well over a wide range of snow conditions. In this embodiment, the skiing apparatus, adapted to receive stiffening plates in accordance with the invention can be designed to be relatively stiff in the middle of the device and be relatively soft and flexible toward the front and rear ends of the device. Without the stiffening plates or with stiffening plates positioned close to the middle of the device, the device will perform well in soft snow and be easier to use by less experienced users. The stiffening plates can be moved away from the middle to provide a stiffer device that will perform well in hard packed snow conditions and be more suited for more experienced users.

In another embodiment, the stiffening plates can be stacked on each other to further increase and adjust the change in flexion and/or torsion characteristics. It is also noted that the stacked plates need not be co-extensive. In this embodiment where a top plate is stacked to a bottom plate, the position of the top plate can be independently adjusted with respect to the bottom plate to further tune the performance of the skiing apparatus, by adjusting the flexion or torsion characteristics of the bottom plate.

In the preceding exemplary Figures, the stiffening elements 170, 270, 470, 570,770, 970, 1070, 1170, 1270 and 1470 have been shown to be plate like with a substantially rectangular cross-section, however as one of ordinary skill will appreciate, the stiffen elements can be constructed having any known cross-section, including for example: round, octagonal, or triangular. Depending upon the cross-sectional shape of the stiffening elements, the shape and/or cross-section of the channel 1207, 1407 in the snowboard 1200, 1400 can adapted to conform and complement the shape of the stiffening elements. In one embodiment, the stiffening elements can be in the form of rods having a round cross-section that are adapted to snap, be clipped or fastened to the round cross-section channels in the surface of the snowboard. The snowboard can have multiple, laterally spaced apart, round cross-sectional channels extending parallel to both of the lateral sides of the snowboard. The flexion and torsion characteristics of the snowboard can be adjusted by installing multiple stiffening rods into specific locations in laterally adjacent channels along the length of the snowboard.

In another embodiment of the invention, the stiffening plates can be applied to a skateboarding device. In this embodiment, the stiffening plates can be mounted to the top or the bottom surface of the skateboard to provide adjustable flexion and torsion characteristics. In this embodiment, the stiffening plates can be adjustable either longitudinally or transversely in order to control the flexion and/or torsion characteristics of the skateboard.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A sliding apparatus comprising:

an elongated board extending along a central axis from a first end to a second end, said elongated board having flexion and torsion characteristics and including a top surface, a bottom surface, and a pair of side edges extending in a direction substantially parallel to said central axis, said elongated board including an elongated ridge extending along a central portion of the top surface and including a side shoulder extending along each side of the top surface, said elongated ridge and said side shoulders forming two recessed channels in the top surface, each of said channels extending substantially parallel to the central axis adjacent to one of said side edges, at least one pair of rigid stiffening elements for changing the flexion or torsion characteristics of said elongated board, each of said stiffening elements extending along a longitudinal axis and being removably fastenable to said elongated board in one of said channels;

fastening means for securely and releasably fastening said at least one pair of stiffening elements at respective first locations in said recessed channels along the length of said elongated board, whereby said stiffening elements are not substantially moveable with respect to the top surface of the elongated board when fastened by said fastening means; and means for adjusting the locations of said stiffening elements in said channels within predefined ranges with respect to said first locations.

2. A sliding apparatus in accordance with claim 1, wherein each of said stiffening elements includes a substantially flat plate.

3. A sliding apparatus in accordance with claim 1, wherein each of said stiffening elements includes a substantially cambered plate.

4. A sliding apparatus in accordance with claim 1, wherein each of said stiffening elements includes a substantially elongated member having a substantially non-rectangular cross-section.

5. A sliding apparatus in accordance with claim 1, wherein each of said stiffening elements includes means for damping vibration of said stiffening elements.

6. A sliding apparatus in accordance with claim 1, wherein said fastening means includes quick release means for releasing said stiffening means from being fastened to said elongated board by operation of a quick release lever or knob.

7. A sliding apparatus in accordance with claim 1, wherein each of said stiffening elements comprises an elongated plate having a first end and a second end and said fastening means includes means for fastening said stiffening elements to said elongated board at a location adjacent said first end of said elongated plate and a location adjacent said second end of said elongated plate.

8. A sliding apparatus in accordance with claim 1, wherein said elongated board includes first interlocking means for mating with a second complementary interlocking means of said stiffening elements to prevent relative movement between said elongated board and said stiffening elements and wherein said stiffening elements include a second interlocking means for mating with said first interlocking means to prevent relative movement between said elongated board and said stiffening elements.

9. A sliding apparatus in accordance with claim 1, wherein said fastening means includes first interlocking means for mating with a second complementary interlocking means of said stiffening elements to prevent relative movement between said fastening means and said stiffening elements and wherein said stiffening elements include a second interlocking means for mating with said first interlocking means to prevent relative movement between said fastening means and said stiffening elements.

10. A sliding apparatus according to claim 1 further comprising binding means adapted for securing boots worn by a user to the top surface of the sliding apparatus.

11. A sliding apparatus according to claim 1 wherein each of said stiffening elements is removably fastened within said channels of said elongated board adjacent to one of said side edges.

12. A sliding apparatus according to claim 1 wherein said elongated board is a snowboard.

13. A sliding apparatus according to claim 1 wherein said elongated board is a snow ski.

14. A sliding apparatus according to claim 1 wherein said elongated board is a wakeboard.

15. A snowboard comprising:

an elongated board extending along a central axis from a first end to a second end, said elongated board having a pair of lateral sides extending substantially parallel to said central axis, a top surface and a bottom surface, said elongated board having flexion and torsion characteristics, two recessed channels, each recessed channel extending parallel to said central axis and located adjacent to a respective one of said lateral sides, at least one pair of rigid stiffening elements, each stiffening element extending along a longitudinal axis and being securely and removably fastenable to said elongated board at a first location in said recessed channel of said elongated board whereby said stiffening element is not moveable with respect to the top surface of the elongated board, said stiffening elements being adapted for changing the stiffness of a portion of said elongated board adjacent said respective first locations, at least one fastening element adapted for coupling to at least one insert fixed to said elongated board for releasably fastening said stiffening elements to said elongated board in said recessed channels, each of said stiffening elements being laterally displaced from, and on opposite sides of, said central axis of the elongated board, and means for adjusting the location of said stiffening elements within a predefined range with respect to said first locations, whereby the stiffness of the elongated board is correspondingly adjusted.

16. A sliding apparatus comprising:

an elongated board extending along a central axis from a first end to a second end, said elongated board having a pair of lateral sides extending in a direction substantially parallel to said central axis, a top surface and a bottom surface and having plurality of fastening inserts fixed to said top surface in a predetermined array pattern, said elongated board having flexion and torsion characteristics, a pair of recessed channels, each of said channels extending parallel to said central axis and located adjacent to a respective one of said lateral sides, at least one pair of rigid stiffening plates, each stiffening plate extending along a longitudinal axis, said stiffening plates including at least one opening to permit a fastening element to extend therethrough, a plurality of fastening elements adapted for coupling to said plurality of fastening inserts for releasably fastening said stiffening plates to said elongated board at respective first locations in said recessed channels, each of said stiffening plates being laterally displaced from, and on opposite sides of, said central axis of the elongated board, so that the longitudinal axis of said stiffening plates is substantially parallel to said central axis to to determine at least in part the flexion or torsion characteristics of said elongated board, and wherein said at least one opening in said stiffening plate permits adjustment of the location of said stiffening plate in the direction of the central axis of the elongated board within a predefined range with respect to said fastening element so as to change the flexion or torsion characteristics of said elongated board.

* * * * *